United States Patent [19]

Svensson

[11] Patent Number: 4,629,868

[45] Date of Patent: Dec. 16, 1986

[54] HEATING PAD, PARTICULARLY FOR VEHICLE SEATS

[75] Inventor: Bo Svensson, Malung, Sweden

[73] Assignee: Autopart Sweden AB, Malung, Sweden

[21] Appl. No.: 740,062

[22] PCT Filed: Sep. 28, 1984

[86] PCT No.: PCT/SE84/00319

§ 371 Date: May 28, 1985

§ 102(e) Date: May 28, 1985

[87] PCT Pub. No.: WO85/01632

PCT Pub. Date: Apr. 11, 1985

[30] Foreign Application Priority Data

Sep. 28, 1983 [SE] Sweden ..... 8305245-6

[51] Int. Cl.[4] ..... H05B 3/36

[52] U.S. Cl. ..... 219/528; 219/549

[58] Field of Search ..... 219/528, 529, 548, 549, 219/211, 212, 217, 200, 201, 213

[56] References Cited

U.S. PATENT DOCUMENTS

| | | | |
|---|---|---|---|
| 1,881,198 | 10/1932 | Kirk | 219/528 |
| 2,021,458 | 11/1935 | Macy | 219/529 |
| 2,715,674 | 8/1955 | Abbott | 219/212 |
| 2,948,802 | 8/1960 | Shaw | 219/212 |
| 3,191,005 | 6/1965 | Cox | 219/528 |
| 3,213,521 | 10/1965 | Overs | 29/613 |
| 3,946,193 | 3/1976 | Giese | 219/211 |
| 4,044,221 | 8/1977 | Kuhn | 219/217 |
| 4,063,069 | 12/1977 | Peeri | 219/217 |

FOREIGN PATENT DOCUMENTS

| | | | |
|---|---|---|---|
| 2908576 | 9/1980 | Fed. Rep. of Germany . | |
| 3013778 | 10/1981 | Fed. Rep. of Germany . | |
| 3040888 | 5/1982 | Fed. Rep. of Germany . | |
| 7514618-3 | 1/1977 | Sweden . | |
| 2061079 | 5/1981 | United Kingdom | 219/548 |

*Primary Examiner*—E. A. Goldberg
*Assistant Examiner*—Teresa J. Walberg
*Attorney, Agent, or Firm*—Young & Thompson

[57] ABSTRACT

A heating pad (1), particularly for vehicle seats, has an electrically insulated heating wire (2) laid in loops between a first covering layer (3) and an intermediate layer (4) united therewith, the opposite side of the intermediate layer being joined to a second covering layer (5). The intermediate layer (4) has a thickness which is at least twice as great as the diameter of the wire (2) and is of a soft and elastic material, suitably foamed plastics, such as to enable the wire to be impressed in said layer with the aid of the first covering layer, while retaining a smooth surface on the first layer (3). The heating wire (2) has a hard insulation of preferably polyetrafluoroethene, and can be elastically moved to one side by a sharp object which penetrates into the heating pad. The pad can be used to advantage in vehicle seats, where it can be sewn directly onto the inside of the seat covering. In a method of producing such a heating pad, a lower part (4, 5) included in the pad is placed on support means equipped with pins, after which the heating wire is laid out in a pattern determined by the pins. A covering layer (3) is then applied.

8 Claims, 5 Drawing Figures

FIG. 1
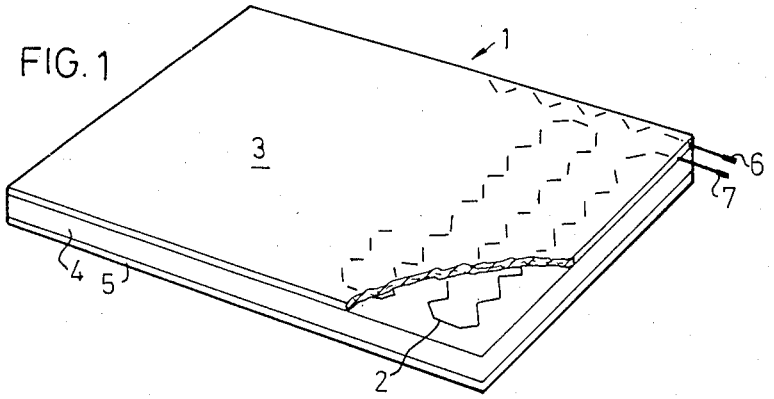
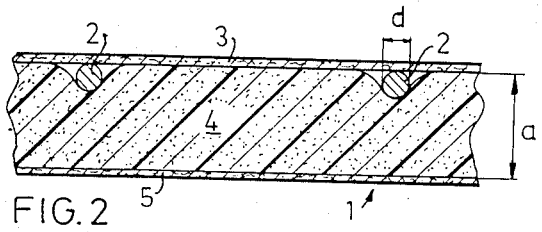
FIG. 2
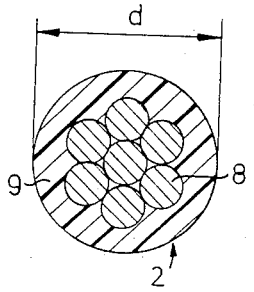
FIG. 3
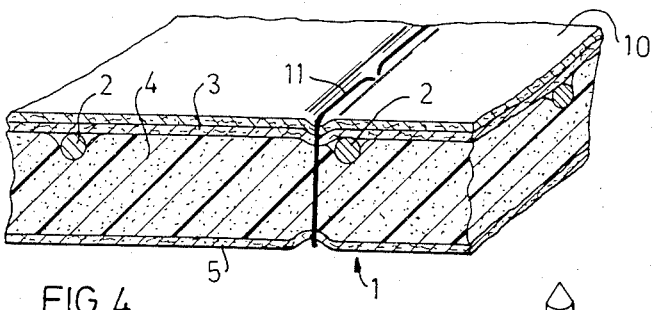
FIG. 4
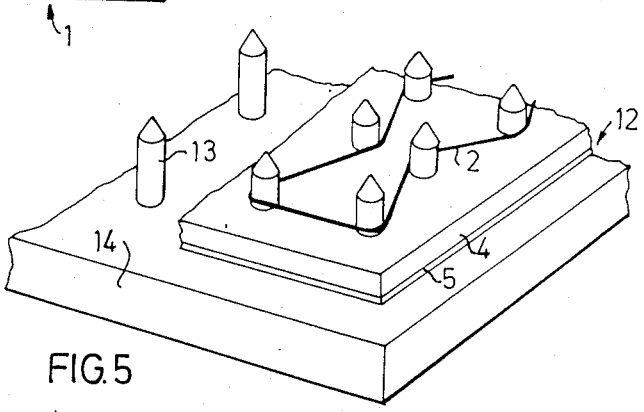
FIG. 5

HEATING PAD, PARTICULARLY FOR VEHICLE SEATS

The present invention relates to a heating pad, particularly for vehicle seats, where at least one electrically insulated heating wire is laid in loops between a first covering layer and an intermediate layer joined to the first layer and united with a second covering layer on its opposite side. The invention also relates to a method of producing and using such a heating pad.

In the use of heating pads of this type for vehicle seats, there is a great risk of the heating pad being damaged, e.g. by sharp objects which penetrate into it and possibly spoil the heating wire. To reduce such risks, the heating wire is often placed under several protecting covering layers included in the pad. Furthermore, the pad has often been placed under one or more layers united with the seat covering, with deteriorated heat exchange as a result. Difficulties have also been encountered in locating the pad relative the seat covering, which is something essential to ensuring good function during a long period.

The object of the present invention is to provide an improved heating pad, which is more resistant to damage than previous heating pads and which permits simple fitting for improved heat exchange. A further object is to provide a heating pad which is simple to manufacture.

This is achieved in accordance with the invention in that the thickness of the intermediate layer is greater than the diameter of the heating wire, preferably at least twice as great as the diameter of the wire; in that the intermediate layer is of soft material, preferably foamed plastics, its elasticity being such that the wire is kept resiliently pressed so far into the intermediate layer by the first covering layer that the latter is given a smooth appearance without protuberances from the heating wire, the intermediate layer forming an elastic support for the heating wire; and in that the wire has a hard insulation, preferably of polytetrafluoroethane, enabling the wire to be moved to one side without being damaged by a sharp object penetrating the heating pad, e.g. a needle. In such a pad, either or both the covering layers preferably consist of woven material. The heating wire can suitably be made up from several strands.

A heating pad of this type can to advantage be applied directly to the inside of the covering of a vehicle seat and fixed to the covering with the aid of through seams without damaging the heating wire. There is thus obtained good location of the heating pad, simultaneously as improved heat exchange is obtained.

Further aspects of the invention will be apparent from the following description and claims.

The invention will now be described in more detail in the following with the aid of an embodiment illustrated on the accompanying drawing, whereon FIG. 1 is a perspective view, partially in section, of a heating pad in accordance with the invention, FIG. 2 is a partial section through the heating pad in FIG. 1, FIG. 3 is a section through a heating wire, to an enlarged scale, FIG. 4 schematically illustrates how a heating pad in accordance with the invention is sewn directly to the covering of a vehicle seat, and FIG. 5 schematically illustrates an inventive heating pad during manufacture.

As will be seen from FIG. 1, there is an electrically insulated heating wire 2 in an inventive heating pad 1, the wire being laid in loops between a first covering layer 3 and an intermediate layer 4 joined thereto, the intermediate layer being joined to a second covering layer 5 on its opposite side. The heating wire 2 is provided with connections 6 and 7 for connection to a voltage supply.

As will be more closely apparent from FIG. 2, the intermediate layer 4 has a thickness a, which is greater than the diameter d of the heating wire. It has been found suitable for the thickness a to be at least twice as great as the diameter d. By making the intermediate layer 4 of soft material with a suitable elasticity, it will be possible to keep the heating wire 2 pressed into the intermediate layer 4 with the aid of the covering layer 3 such that the latter is given a smooth appearance without any protuberances caused by the heating wire. The first covering layer 3 and the intermediate layer 4 are joined to each other over the entire surface of the heating pad, with the exception of narrow zones at the heating wire, as is apparent from FIG. 2. The different loops of the heating wire 2 are thus located in the heating pad in a simple and effective way. In this configuration the intermediate layer 4 forms an elastic support for the heating wire 2, which thus obtains a certain amount of limited lateral freedom of movement. Without being damaged, the heating wire can thus move away from such as a needle which is taken through the heating pad at the place where the wire happens to be. The heating wire naturally has the opportunity of gliding to a limited extent away from other objects which come against the pad from above, e.g. such as hard objects in the pockets of a driver.

The heating wire 2, as will be apparent from FIG. 3, is suitably made up from a plurality of separate strands 8 around which there is a hard insulation 9, suitably of polytetrafluoroethene. The wire 2 is thus given good outer protection and also good flexibility.

Foamed plastics such as polyethene or polyester are suitably used as the material in the intermediate layer 4. Woven material is used to advantage in the covering layers 3 and 5. In an advantageous embodiment of the heating pad 1 in accordance with the invention, woven fabric has been used for the covering layers 5 and 3 and foamed plastics with a thickness a of about 3 mm has been used for the intermediate layer 4. The diameter d of the heating wire 2 has in this case been between about 0.6 and 0.8 mm.

A heating pad 1 of the type described here can be used to advantage for vehicle seats. As is apparent from FIG. 4, it may then be sewn directly against the inside of the covering 10 of a vehicle seat with the aid of one or more suitably placed seams 11 and with the heating wire 2 placed closest the covering 10. The pad 1 can be sewn in place by a multi-needle machine, for example, the seams being placed in a manner suiting the configuration of the seat and where it is desired to have decorative seams. The closeness of the heating wire to the seat covering gives good heat transfer.

In producing a heating pad having an intermediate layer of foamed plastics and a covering layer of fabric, it is first suitable to laminate together the intermediate layer 4 and the lower covering layer 5. A suitable method here is flame lamination, since continuous webs of intermediate layer and covering layer can be brought together. A unit 12 comprising an intermediate layer 4 and a second covering 5, intended as a heating pad, is placed on support means 14 (see FIG. 5) provided with a plurality of upstanding pins 13. The unit 12 is then pressed against the support means 14 so that the pins 13 pierce both the second covering layer 5 and the intermediate layer 4. Using a robot, for example, the heating wire 2 is then laid out on the intermediate layer 4 in a pattern corresponding to the desired serpentine form and determined by the pins 13. On termination on laying out the heating wire 2, there is first placed on the intermediate layer 4 a laminating film, a glue coating or the like, and thereafter the first covering layer 3. The pins 13 penetrate right up through the first covering layer 3. By then subjecting the first covering layer 3 to pressure and heat, the heating wire 2 is pressed down into the intermediate layer 4 so that a heating element with the appearance illustrated in FIG. 2 is obtained. The heating element is then removed from the support means and its pins 13, with the heating wire 2 now securely fixed, but still not entirely immovable in the heating pad.

A heating pad of the type described here has been found to be particularly advantageous for use in vehicle seats, but it may of course be used in other connections as well. Possible uses are such as in overalls and heated blankets. The type of material and number of heating wires can naturally be varied within the scope of the invention.

By the heating wire 2 being kept impressed in the intermediate layer 4, it is avoided that the wire will be visible in the form of protuberances in the covering of a vehicle seat to which the heating pad has been fitted. This is important from the aesthetic aspect, particularly when the seat covering is leather.

If so desired, both the intermediate layer and either or both of the covering layers can be made from several layers of material, which may be of different types.

I claim:

1. Heating pad comprising at least one electrically insulated heating wire (2) laid in loops between a first covering layer (3) and an intermediate layer (4) joined to said first covering layer, on its opposite side the intermediate layer being joined to a second covering layer (5), the heating wire being laid out in its intended pattern on the intermediate layer without being secured to the intermediate layer, said intermediate layer being of soft material and having a thickness at least twice as great as the diameter of the wire, the elasticity of the intermediate layer being such that the heating wire is kept resiliently impressed to such a depth in the intermediate layer by the first covering layer that the first covering layer has a smooth appearance, the heating wire being free to displace elastically sideways in the heating pad, said heating wire having a hard insulation on the surface thereof, the heating wire being thus enabled to be moved elastically to one side without being damaged by a sharp object penetrating the heating pad.

2. Heating pad as claimed in claim 1, in which the first covering layer (3) is a woven material and is secured to the intermediate layer via a laminating film.

3. Heating pad as claimed in claim 1, in which the second covering layer (5) is a woven material and is flame laminated to the intermediate layer.

4. Heating pad as claimed in claim 1, in which the heating wire (2) is made up from several strands (8).

5. Heating pad as claimed in claim 1, in which the thickness (a) of the intermediate layer (4) is about 3 mm, and the diameter (d) of the heating wire (2) is less than 1 mm.

6. Heating pad (1) as claimed in clainm 5, in which the diameter (d) of the heating wire (2) is about 0.06–0.8 mm.

7. Heating pad (1) as claimed in claim 1, in which the pad (1) is sewn onto the inside of the covering (10) of a vehicle seat, with the heating wire nearest the covering.

8. Heating pad (1) as claimed in claim 1, in which said intermediate layer is of foamed plastic.

* * * * *